US010608341B2

(12) United States Patent
Song et al.

(10) Patent No.: US 10,608,341 B2
(45) Date of Patent: Mar. 31, 2020

(54) WIDEBAND ASYMMETRIC SLOT ANTENNA

(71) Applicant: GM GLOBAL TECHNOLOGY OPERATIONS LLC, Detroit, MI (US)

(72) Inventors: Hyok Jae Song, Oak Park, CA (US); James H. Schaffner, Chatsworth, CA (US); Timothy J. Talty, Beverly Hills, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 5 days.

(21) Appl. No.: 15/916,698

(22) Filed: Mar. 9, 2018

(65) Prior Publication Data

US 2019/0280389 A1 Sep. 12, 2019

(51) Int. Cl.

| | |
|---|---|
| ***H01Q 13/10*** | (2006.01) |
| ***H01Q 1/12*** | (2006.01) |
| *H01Q 1/32* | (2006.01) |

(52) U.S. Cl.

CPC ..... *H01Q 13/103* (2013.01); *H01Q 1/1271* (2013.01); *H01Q 1/325* (2013.01)

(58) Field of Classification Search

CPC ..... H01Q 1/42; H01Q 1/286; H01Q 13/18; H01Q 1/38; H01Q 13/085

USPC ..... 343/767, 741, 772, 789

See application file for complete search history.

(56) References Cited

U.S. PATENT DOCUMENTS

| | | | | |
|---|---|---|---|---|
| 2002/0175873 | A1* | 11/2002 | King | B65D 5/4233 343/767 |
| 2012/0127050 | A1* | 5/2012 | Song | H01Q 1/1271 343/756 |
| 2013/0082884 | A1* | 4/2013 | Gummalla | G06F 1/1656 343/702 |
| 2019/0056309 | A1* | 2/2019 | Gruber | G01N 21/01 |

* cited by examiner

*Primary Examiner* — Andrea Lindgren Baltzell
(74) *Attorney, Agent, or Firm* — Lorenz & Kopf, LLP

(57) ABSTRACT

The present application generally relates to antennas embedded in or on glass structures. More specifically, the application teaches a wideband coplanar antenna employing a slot shape in the ground plane configured to accomplish a broadband frequency response wherein the two axis of symmetry in the antenna design are fragmented in order to maximize resonances of RF currents over broader frequency bands.

8 Claims, 3 Drawing Sheets

310

WIDEBAND ASYMMETRIC SLOT ANTENNA

BACKGROUND

The present application generally relates to wideband conformal antennas. More specifically, the application teaches a wideband conformal antenna employing a various slot shape and size in the ground plane to accomplish a broadband frequency response wherein the two axis of symmetry in the antenna design are fragmented in order to maximize resonances of RF currents over broader frequency bands.

Background Information

Coplanar waveguide fed slot antennas typically consist of a ground plane and a feed element on the same side of a dielectric substrate. The feed element is positioned in a manner to excite the slot and radiate energy in an orthogonal direction to the plane of the slot. However, slot antennas resonate at a frequency corresponding to the dimensions of the slot and have limited efficiency at other frequencies and therefore have a very narrow bandwidth. A common method to improve bandwidth of an antenna is to employ a slot with gradually changing dimensions. A further improvement in the bandwidth was shown possible by introducing a set of tuning stubs in the slot. It would be desirable to extend the bandwidth available to the antenna without increasing the aperture size.

SUMMARY

Embodiments according to the present disclosure provide a number of advantages. For example, embodiments according to the present disclosure may facilitate greater frequency bandwidth for coplanar antennas and vehicular applications thereof.

In accordance with an aspect of the present invention, a coplanar antenna comprising a substrate having a first side and a second side, a slot antenna structure formed on the second side of the substrate wherein the slot antenna structure is asymmetrical in a first direction and wherein the slot antenna structure is fed by a coplanar waveguide feed coupled to a first tuning stub within the slot antenna structure and a second tuning stub within the slot antenna structure and wherein the first tuning stub and the second tuning stub are asymmetrical in the first direction.

In accordance with another aspect of the present invention, a vehicular communications system comprising a planar dielectric substrate having a first side interior to a vehicle and a second side exterior to a vehicle, a transceiver, a slot antenna structure formed on the second side of the planar dielectric substrate wherein the slot antenna structure is asymmetrical in a first direction, wherein the slot antenna structure has a first tuning stub formed within the slot antenna structure and a second tuning stub formed within the slot antenna structure and wherein the first tuning stub and the second tuning stub are asymmetrical in the first direction, and a coplanar waveguide feed coupled to the transceiver and the first tuning stub and the second tuning stub wherein the first tuning stub is longer than the second tuning stub.

The above advantage and other advantages and features of the present disclosure will be apparent from the following detailed description of the preferred embodiments when taken in connection with the accompanying drawings.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

The exemplifications set out herein illustrate preferred embodiments of the invention, and such exemplifications are not to be construed as limiting the scope of the invention in any manner.

DETAILED DESCRIPTION

The following detailed description is merely exemplary in nature and is not intended to limit the disclosure or the application and uses thereof. Furthermore, there is no intention to be bound by any theory presented in the preceding background or the following detailed description. For example, the circuitry, transmission lines and antennas of the present invention has particular application for use on a vehicle. However, as will be appreciated by those skilled in the art, the invention may have other applications.

Figure 1:
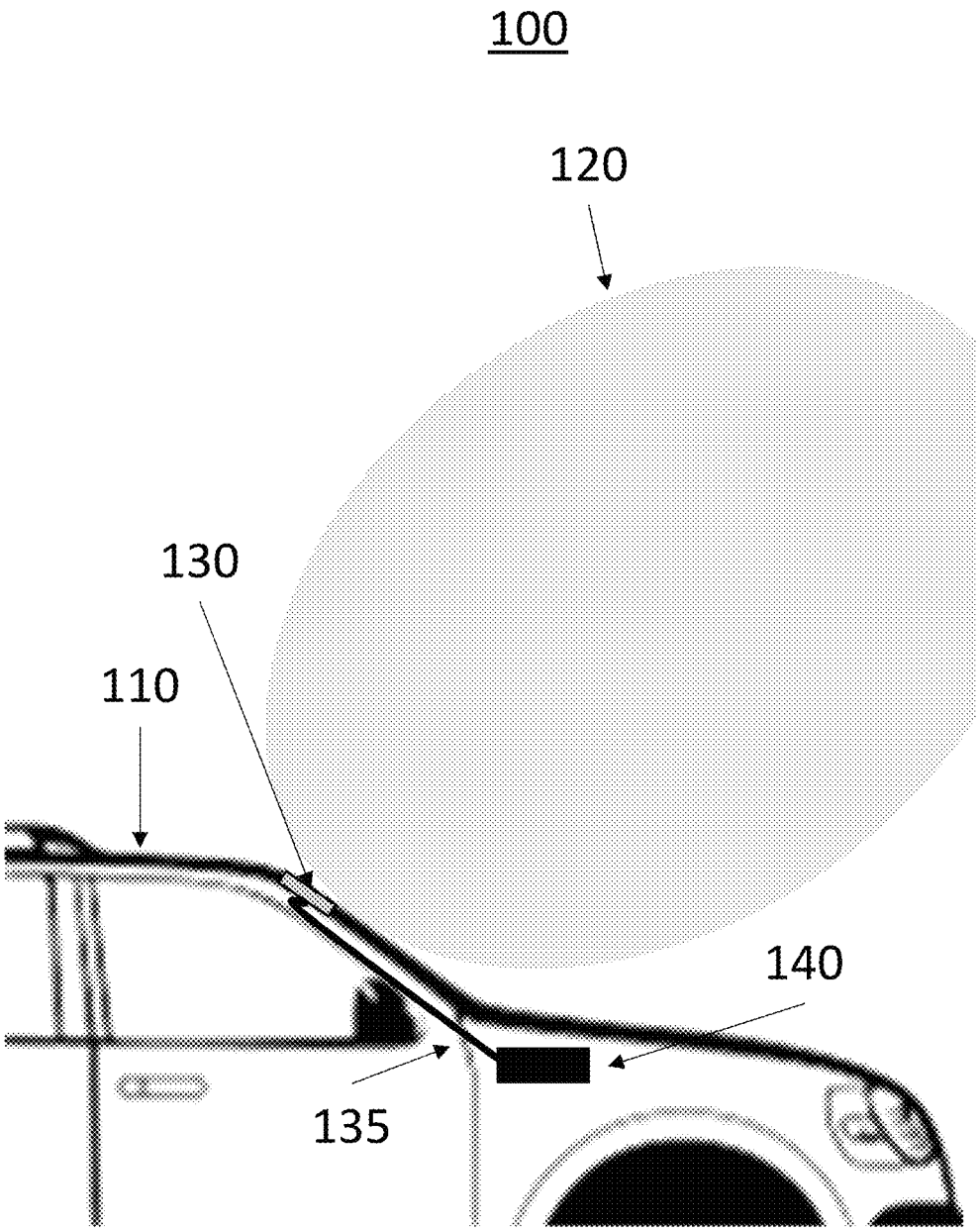
FIG. 1 illustrates an exemplary application of the vehicle integrated antenna with enhanced bandwidth in an automotive environment according to an embodiment.

FIG. 1 illustrates an exemplary application of the vehicle integrated antenna with enhanced bandwidth in an automotive environment 100. The exemplary application shows a vehicle 110 with windshield, an exemplary radiation pattern 120 of a conforming antenna 130 mounted to a sloped windshield. The antenna 130 is coupled via a transmission line 135 which includes a coplanar waveguide feed to a communications system 140.

Figure 2:
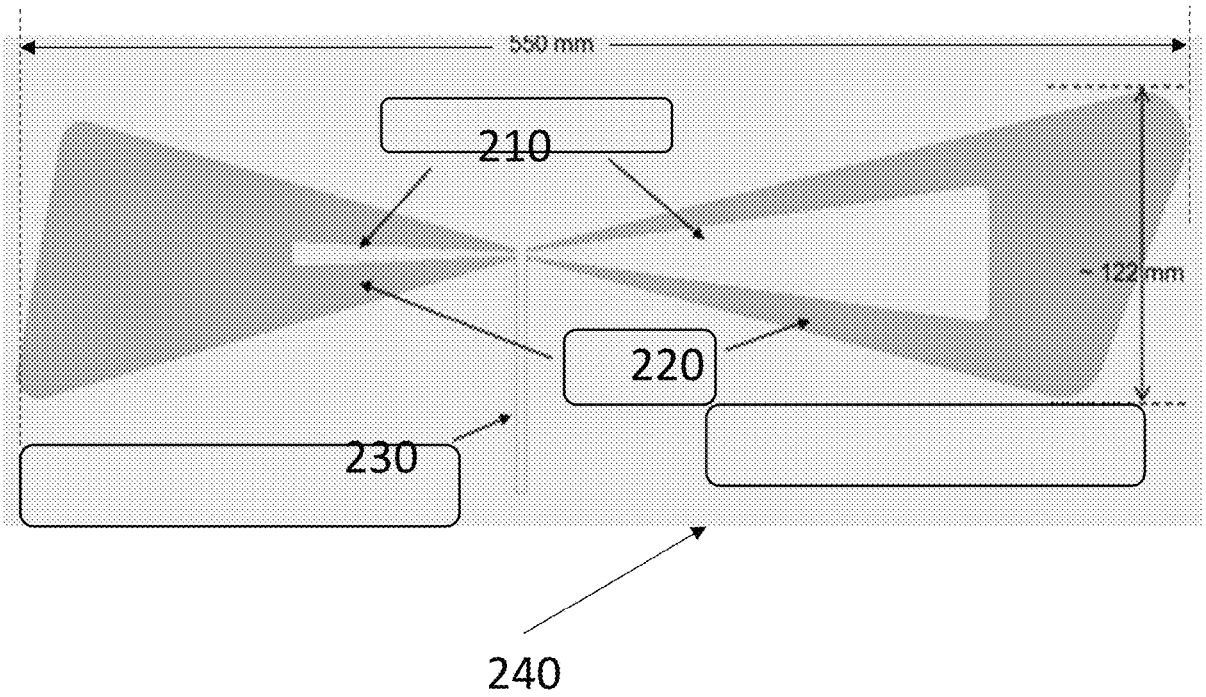
FIG. 2 is an exemplary antenna design according to an embodiment.

Turning now to FIG. 2 an exemplary antenna design 200 according to the present disclosure is shown. In this exemplary embodiment, a wideband conformal antenna is taught that can continuously cover the entire 4G LTE frequency bands from 450 MHz and at least up to 2600 MHz for an equivalent bandwidth of greater than 140%. The antenna is a coplanar waveguide (CPW) fed slot type of antenna, in which the slot is in the ground plane layer 240. The presently disclosed antenna employs asymmetry in two axis in the antenna design to maximize resonances of RF currents over broader frequency bands to cover the entire 4G LTE spectrum from 450 MHz to 2600 MHz. In this exemplary embodiment, the slot portion of the antenna has overall dimensions of approximately 550 mm by 122 mm.

A CPW-line 230 is employed to achieve the desired bandwidth, wherein along with the asymmetric slots 220 and the CPW line 230 enable the desired increased bandwidth. In an exemplary embodiment, the antenna is fabricated on 1.9 mm thick Rogers TMM-4 substrate (relative dielectric constant=4.7) which has the RF dielectric property close to an automotive windshield. The antenna fabricated using the TMM-4 substrate features the asymmetric slots 220 and the asymmetric tuning stubs 210, thereby fully exploiting the asymmetry in the antenna geometry in order for RF currents to be supported over as wideband as possible. It should be noted that the proposed antenna could be easily modified for different substrate material including but not limited to the automotive windshield. The antenna may be fabricated using non sharp edges in order to increase the realized bandwidth and to reduce abrupt losses of gain over a frequency range.

Figure 3A:
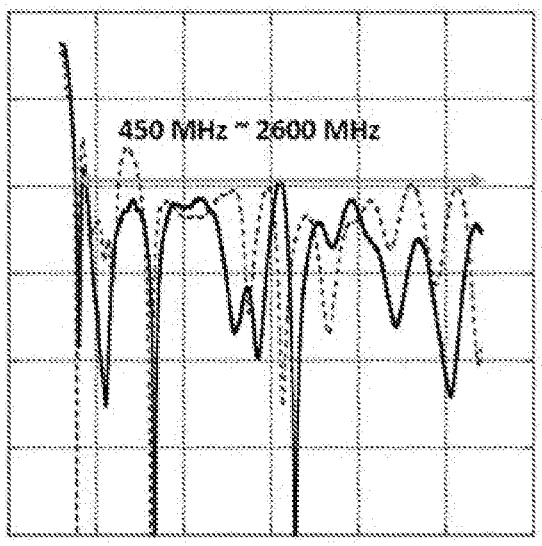
FIG. 3*a* is an exemplary impedance matching of the exemplary antenna according to an embodiment.
Figure 3B:
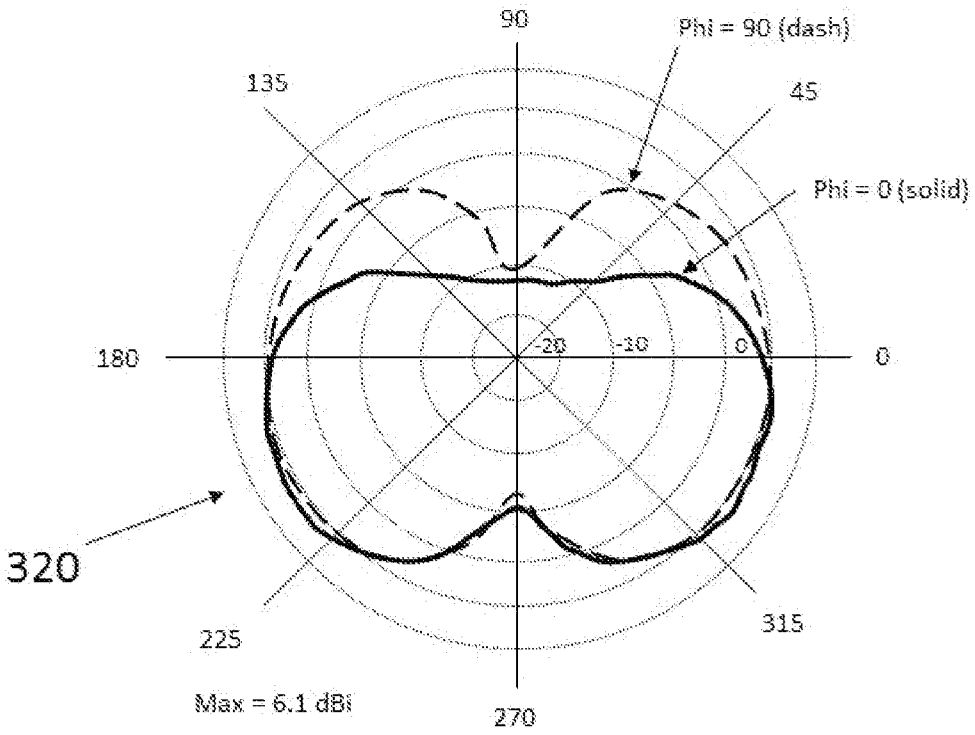
FIG. 3*b* is an exemplary radiation pattern of the exemplary antenna according to an embodiment.

Turning now to FIG. 3*a*, the return loss 310 of the exemplary antenna is shown. This shows excellent wideband frequency response with good impedance matching over the entire 4G LTE bands. Turning to FIG. 3*b* a simulated radiation pattern 320 is shown for the exemplary antenna. The simulated radiation pattern changes over the wide frequencies corresponding to different electrical aperture size which is expected. Maximum gain of the exemplary pattern shows approximately 4~6 dBi.

The exemplary CPW-fed single layer, wideband slot type of antenna, may employ full asymmetry in the aperture at two axes, full asymmetry in the tuning stubs 210 at two axes and rounded, or non sharp, edges in the slots 220 and tuning stubs 210.

What is claimed is:

1. A vehicular communications system comprising:

a planar dielectric substrate having a first side interior to a vehicle and a second side exterior to a vehicle wherein the planar dielectric substrate is a vehicle windshield;

a transceiver;

a slot antenna structure formed on the second side of the planar dielectric substrate wherein the slot antenna structure is asymmetrical in a first direction, wherein the slot antenna structure has a first tuning stub formed within the slot antenna structure and a second tuning stub formed within the slot antenna structure and wherein the first tuning stub and the second tuning stub are asymmetrical in the first direction wherein the slot antenna structure is positioned such that at least one surface wave is coupled to the dielectric material and wherein the surface wave propagates in a path parallel to the first direction; and a coplanar waveguide feed, formed on the second side of the planar dielectric substrate, coupled to the transceiver and the first tuning stub and the second tuning stub wherein the first tuning stub is longer than the second tuning stub.

2. The vehicular communications system of claim 1 wherein the slot antenna structure is asymmetrical in a second direction.

3. The vehicular communications system of claim 1 wherein the slot antenna structure is formed by an absence of conductive material within a plane of conductive material.

4. The vehicular communications system of claim 1 wherein the slot antenna structure is bow tie shaped.

5. The vehicular communications system of claim 1 wherein the first tuning stub has a first length in the first direction and the second tuning stub has a second length in the first direction and wherein the first length is greater than the second length.

6. The vehicular communications system of claim 1 wherein slot antenna structure has a narrowed region proximate to a coupling point of the coplanar waveguide feed and the first tuning stub.

7. The vehicular communications system of claim 1 wherein slot antenna structure has a narrowed region proximate to a coupling point of the coplanar waveguide feed and the first tuning stub.

8. The vehicular communications system of claim 1 wherein the slot antenna structure is approximately 122 mm by 500 mm.

* * * * *